United States Patent [19]

Kosugi et al.

[11] Patent Number: 4,669,805

[45] Date of Patent: Jun. 2, 1987

[54] HIGH FREQUENCY CONNECTOR

[76] Inventors: Yuhei Kosugi; Shigeo Ogawa, both c/o NEC Corporation, 33-1, Shiba 5-chome, Minato-ku, Tokyo, Japan

[21] Appl. No.: 747,658

[22] Filed: Jun. 21, 1985

[30] Foreign Application Priority Data

Jun. 27, 1984 [JP] Japan ..... 59-132618

[51] Int. Cl.[4] ..... H01R 17/18

[52] U.S. Cl. ..... 439/581; 439/887; 439/81; 333/21 R

[58] Field of Search ..... 339/64 M, 65, 177 R, 339/177 E, 30, DIG. 1, DIG. 3, 252 R, 278 C, 17 R, 17 C, 17 LC; 333/21 R, 260, 246

[56] References Cited

U.S. PATENT DOCUMENTS

| | | | |
|---|---|---|---|
| 3,111,352 | 11/1963 | Theodoseau | 339/30 |
| 3,239,713 | 3/1966 | Evans et al. | 333/21 R |
| 3,242,456 | 3/1966 | Duncan | 339/64 M |
| 3,622,915 | 11/1971 | Davo | 339/17 R |
| 3,705,379 | 12/1972 | Bogar | 339/21 R |
| 3,783,321 | 1/1974 | Patterson | 339/17 R |
| 3,975,077 | 8/1976 | Peterson | 339/177 R |
| 4,159,505 | 6/1979 | Carp et al. | 339/17 R |
| 4,280,112 | 7/1981 | Eisenhart | 339/21 R |
| 4,487,465 | 11/1984 | Cherian | 339/30 |

*Primary Examiner*—Eugene F. Desmond
*Assistant Examiner*—David Pirlot

[57] ABSTRACT

A high frequency connector for interconnecting a microstrip circuit and an external circuit. That portion of a center conductor which is adjacent to the microstrip circuit is deviated from the axis of the connector and resiliently supported, thereby eliminating an intermediary element for interconnection to promote easy and positive interconnection. The connector is desirably applicable to TEM mode waves lying in the frequency band of 0.3–30 GHz.

8 Claims, 25 Drawing Figures

HIGH FREQUENCY CONNECTOR

BACKGROUND OF THE INVENTION

The present invention relates to a high frequency connector adapted for interconnecting a microstrip circuit and an external circuit and, more particularly, to a connector structure suited to connect transverse electromagnetic mode (TEM) waves which lie in a 0.3–30 GHz frequency band.

A microstrip substrate is an implementation recently developed for the circuit construction of various equipments of the kind which use the microwave band. One of the major problems with a microstrip substrate is the interconnection between the substrate and an external circuit. FIGS. 1 and 2 show different prior art connectors which may be used to interconnect a conductor section of a microstrip substrate, which is received in a housing, to a coaxial cable. In FIG. 1, a connector 10 is fit in a bore 18 formed in a wall 16 of a housing 12, which accommodates a microstrip substrate 14 therein. Specifically, the connector 10 comprises a shell 20 provided with a flange 22 and a male screw 24 which is to mate with an external circuit, an intermediary insertion member 26 coupled in the shell 20 and in the bore 18 of the wall 16 of the housing 12, and a center conductor 28 supported by an insulator 30 inside the hollow shell 20 and insertion member 26. Before mounting the connector 10 to the housing 12, the microstrip substrate 14 is fixed in a predetermined position inside the housing 12. Then, the insertion member 26 of the connector 10 is inserted into the bore 18 of the housing 12, then a center conductor pin 34 provided with a connecting ribbon 32 beforehand is inserted into a slitted portion 28*a* of the center conductor 28 from inside the housing 12, and then the ribbon 14 is soldered to a corresponding conductor portion on the substrate 14.

In FIG. 2, a prior art connector 36 of the type using a glass bead 38 is shown. The bead 38 comprises a tube 39 made of metal and a center conductor pin 40 which is fixed in place by glass 42 at the center of the tube 38. In assembly, the bead 38 is inserted into the housing 12 to align with a conductor on the microstrip substrate 14, then solder is poured into a bore 44 provided in the upper end of the housing 12 so as to fix the bead 38 in place, then the center conductor pin 40 and a conductor portion of the substrate 14 are soldered to each other, and then the connector 36 is screwed into the housing 12.

The problem with the connector configuration shown in FIG. 1 is that due to the substantial inductive impedance of the ribbon 32 the voltage standing-wave ratio (VSWR) is high at frequencies higher than several gigaherzs. Another problem is that the connection of the ribbon 32 requires extra steps. Meanwhile, the connector configuration shown in FIG. 2 is disadvantageous in that a considerable number of steps are necessary for the bead 38 to be fixed in place by solder, which is poured into the bore 44 of the housing 12, and in that the manipulation for replacing the microstrip substrate is intricate. In addition, both the connectors shown in FIGS. 1 and 2 are expensive to produce and need expensive structural parts.

SUMMARY OF THE INVENTION

It is therefore an object of the present invention to provide a high frequency connector which interconnects a microstrip circuit and an external circuit with a desirable microwave transmission characteristic.

It is another object of the present invention to provide a high frequency connector for interconnecting a microstrip circuit and an external circuit which is simple in construction and easy to assemble.

It is another object of the present invention to provide a generally improved high frequency connector.

A connector for interconnecting an external circuit mounted on a housing, which accommodates a high frequency circuit therein, and the high frequency circuit of the present invention comprises a tubular shell made of metal and mounted on the housing, the tubular shell including a hollow portion which functions as an external conductor, an elongate center conductor extending on and along a center axis of the hollow portion of the shell and connected at one end portion to the high frequency circuit and at the other end portion to the external circuit, and a support member made of insulating material for supporting the center conductor in the hollow portion of the shell. The center conductor is cantilevered by the support member at a point of the center conductor which is remote from the one end portion and adjacent to the other end portion. A tip of the one end portion is free and movable.

In accordance with the present invention, a high frequency connector for interconnecting a microstrip circuit and an external circuit is provided. That portion of a center conductor which is adjacent to the microstrip circuit is deviated from the axis of the connector and resiliently supported, thereby eliminating an intermediary element for interconnection to promote easy and positive interconnection. The connector is desirably applicable to TEM mode waves lying in the frequency band of 0.3–30 GHz.

The above and other objects, features and advantages of the present invention will become more apparent from the following detailed description taken with the accompanying drawings.

DESCRIPTION OF THE PREFERRED EMBODIMENTS

While the high frequency connector of the present invention is susceptible of numerous physical embodiments, depending upon the environment and requirements of use, substantial numbers of the herein shown and described embodiments have been made, tested and used, and all have performed in an eminently satisfactory manner.

Figure 1:
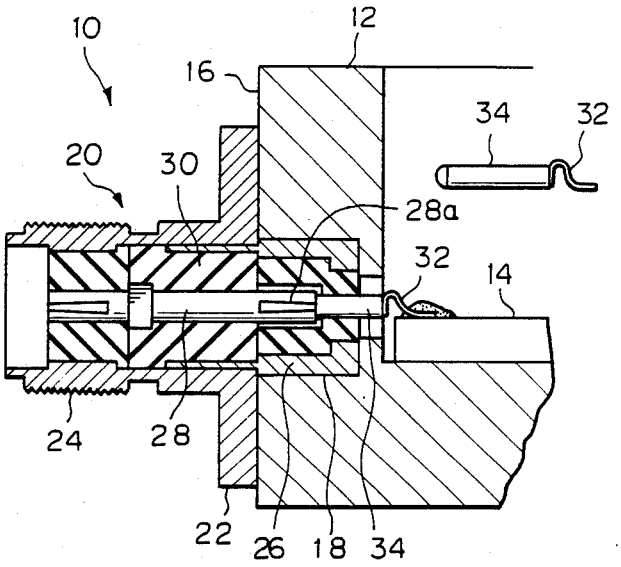
Fig. 1 PRIOR ART
FIGS. 1 and 2 are sections each showing a prior art high frequency connector.
Figure 2:
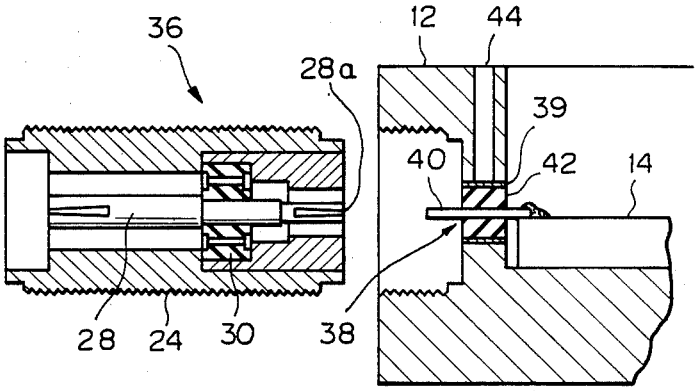
Fig. 2 PRIOR ART
Figure 3:
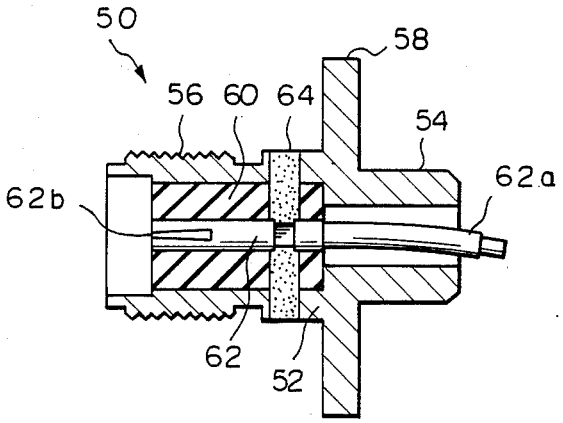
FIG. 3 is a section of a high frequency connector embodying the present invention.
Figure 4:
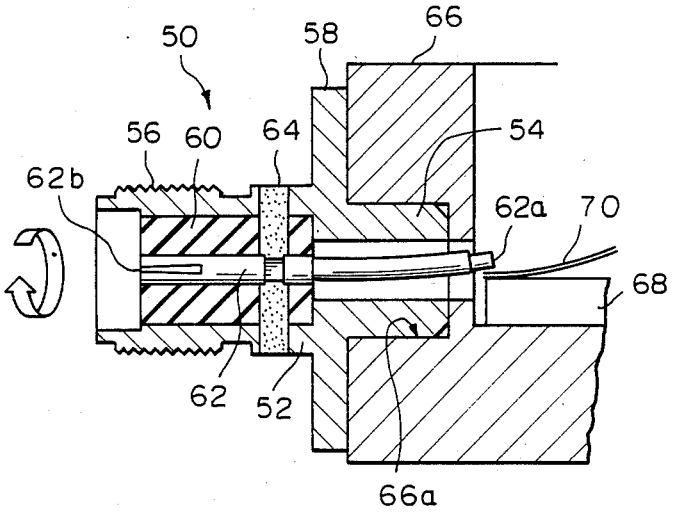
FIGS. 4 and 5 show the connector of FIG. 3 mounted on a housing, which has a microstrip substrate therein, as well as a mounting procedure.

Referring to FIG. 3, a connector embodying the present invention is shown and generally designated by the reference numeral 50. FIG. 4 shows the connector of FIG. 3 in a position mounted on a housing 66 which has a microstrip circuit therein. As shown, the connector 50 comprises a shell 52 which includes a mating member 54 which in turn is provided with a male screw 56 and a flange 58, and an insulator 60 for supporting a center conductor 62. The left end of the center conductor 62 as viewed in FIG. 3 is rigidly retained by the insulator 60 inside the male screw 56.

A characteristic feature of the illustrative embodiment is that the center conductor 62 is cantilevered at its side (right-hand side as viewed in FIG. 3) adapted to connect to a microstrip circuit and terminates at a free end at that side. In addition, the tip 62*a* of the center conductor 62 is deviated from the axis of the shell 52 and mechanically movable within a certain limited range. The insulator 60 is made of tetrafluoroethylene, or Teflon (trade name), or like low-loss dielectric material. The insulator 60 and center conductor 62 are prevented from rotating relative to the shell 52 by resin 64 which is injected and then cured. In FIG. 4, the lengthwise dimension of a projection included in the mating member 54 coincides with the depth of a bore 66*a* provided in the housing 66 within the range of machining errors, so that the relative position between the center conductor 62 and the microstrip substrate 68 is adequately restricted. The center conductor 62 has a slit 62*b* at its left end as seen in the drawings in which a center conductor of another connector is engageable.

Figure 5:
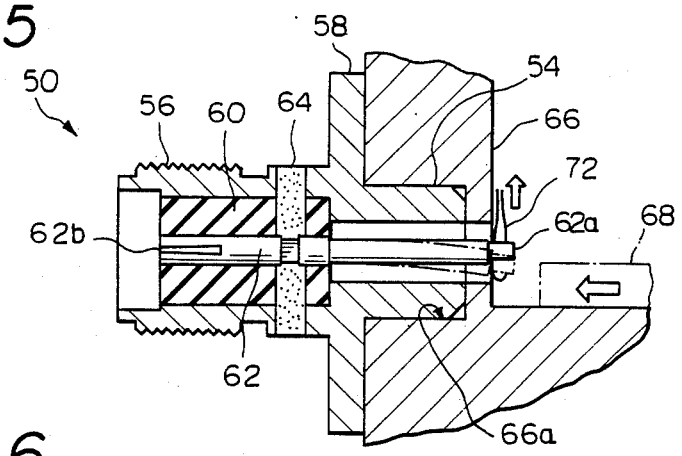

Two different methods are available for mounting the connector 50 on the housing 66. One of them is such that, as shown in FIG. 4, the microstrip substrate 68 is fixed to the housing 66, then the connector 50 is inserted into the housing 66 with the tip 62*a* of the center conductor 62 directed upwardly, and then the connector 50 is rotated 180 degrees about its axis to cause the conductor tip 62*a* to abut against a conductor surface on the microstrip substrate 68 under predetermined pressure. Preferably, a thin sheet 70 of polyester or polyimid, for example, is placed between the conductor tip 62*a* and the substrate 68 in order to avoid possible damage to the conductor surface on the substrate 68. The other method is such that, as shown in FIG. 5, the conductor tip 62*a* is raised by means of a wire 72 and then the microstrip substrate 68 is inserted as indicated by an arrow to a predetermined fixing position.

The conductor tip 62*a* may be formed using a shape-memorizing alloy. In such a case, the connector 50 will be inserted into the housing 66 after processing, such as cooling, the deformable conductor tip 62*a* to a temperature other than room temperature to straighten it; upon return to room temperature, the conductor tip 62*a* will show a given amount of deviation to exert an adequate contact pressure on the substrate 68.

Figure 6:
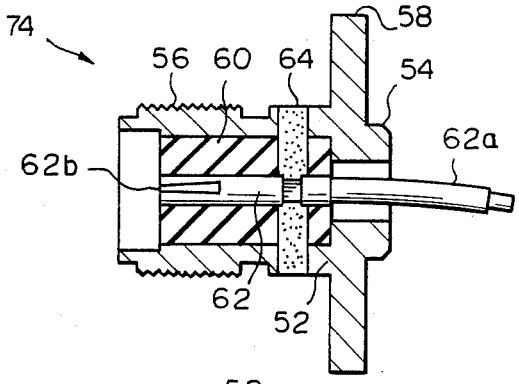
FIG. 6 is a section of a connector in accordance with another embodiment of the present invention.
Figure 7:
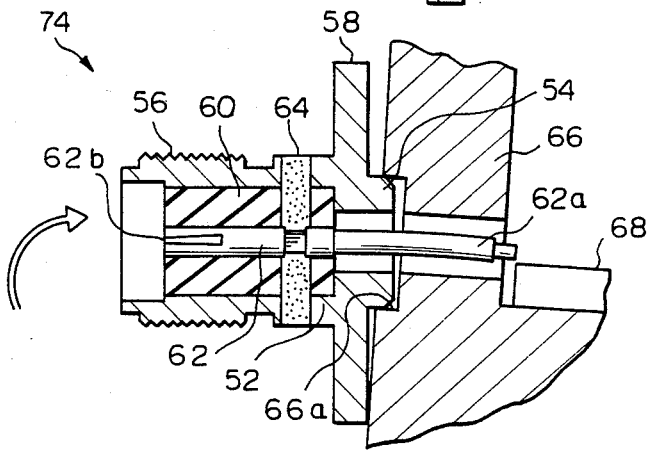
FIG. 7 shows the connector of FIG. 6 mounted on a housing, which has a microstrip substrate therein, as well as a mounting procedure.

Referring to FIGS. 6 and 7, another embodiment of the present invention is shown. A connector, generally 74, in accordance with this particular embodiment has the mating member 54 of the shell 52 which is relatively short, the bore 66*a* in the housing 66 being correspondingly reduced in depth. As shown in FIG. 7, the connector 74 with such a configuration is held in an inclined position and then inserted into the bore 66*a*. Such eliminates the need for handling the conductor tip 62*a* in the manner shown in FIG. 5.

In any of the two embodiments described above, after the connector 50 or 74 has been coupled in the housing 66, the flange 58 is fastened to the housing 66 by means of screws or the like (not shown).

Figure 8:
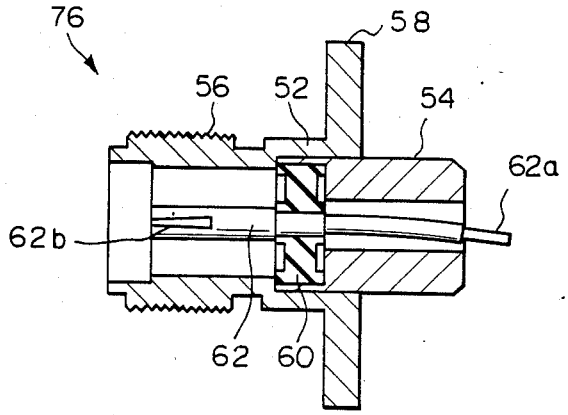
FIG. 8 is a section of a connector in accordance with another embodiment of the present invention.
Figure 9:
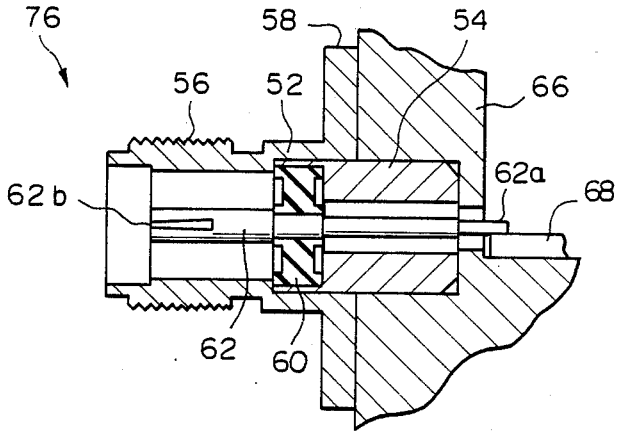
FIG. 9 shows the connector of FIG. 8 mounted on a housing, which has a microstrip substrate therein, as well as a mounting procedure.

Referring to FIG. 8, another embodiment of the present invention is shown. A connector, generally 76, has the insulator 60 for supporting the center conductor 62 which is relatively short. Specifically, the dielectric which supports the center conductor 62 is dimensioned as small as possible so that the center conductor 62 may be surrounded by air, thereby increasing the cutoff frequency for needless modes. The connector 76 is shown in a mounted position in FIG. 9.

Figure 10:
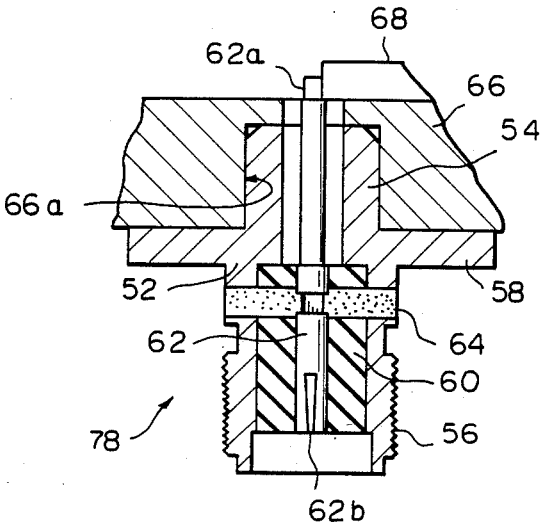
FIGS. 10 and 11 are sections of a connector in accordance with another embodiment of the present invention which is positioned perpendicularly to a microstrip substrate.
Figure 11:
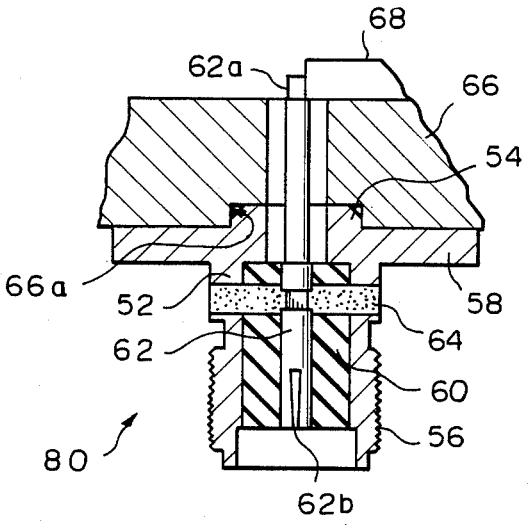
Figure 12:
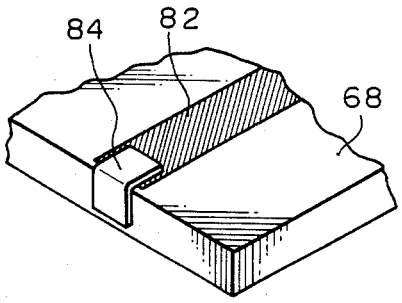
FIG. 12 is a perspective view of a portion of the microstrip substrate with which the tip of a center conductor of the connector shown in any of FIGS. 3–11 makes contact.
Figure 13:
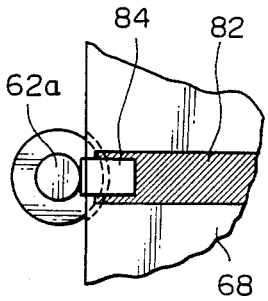
FIG. 13 is a plan view of the substrate portion of FIG. 12.
Figure 14:
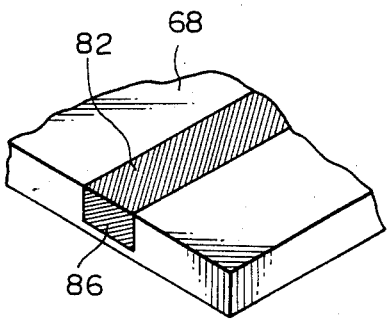
FIG. 14 is a perspective view of a modification to the substrate portion shown in FIG. 12.

Referring to FIGS. 10 and 11, another embodiment of the present invention is shown in which a connector 78 or 80 is mounted to the housing 66 such that the center conductor 62 extends perpendicular to the microstrip substrate 68. In FIG. 10, the shell 52 is provided with a relatively long mating member 54 while, in FIG. 11, it is provided with a relatively short mating member 54. In any of the configurations shown in FIGS. 10 and 11, as shown in FIG. 12, a generally L-shaped conductor piece, or contact, 84 is thermally bonded or soldered to an end of a conductor 82 which is provided on the surface of the microstrip substrate 68. This particular portion of the substrate 68 is shown in a plan view in FIG. 13. Alternatively, as shown in FIG. 14, side conductor 86 may be provided on the substrate 68 by baking a conductor paste.

Figure 15:
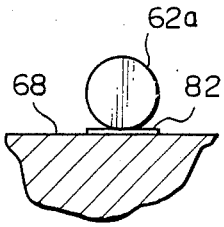
FIG. 15 shows a manner of contact between a connector center conductor and a microstrip substrate conductor.
Figure 16A:
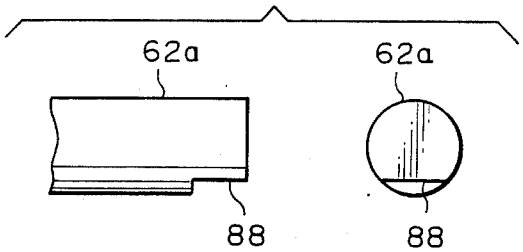
FIGS. 16A–16D show various configurations of that portion of a connector center conductor which makes contact with a microstrip substrate.
Figure 16B:
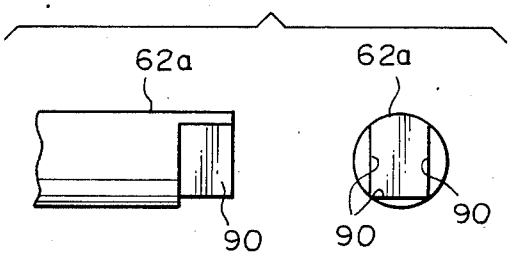
Figure 16C:
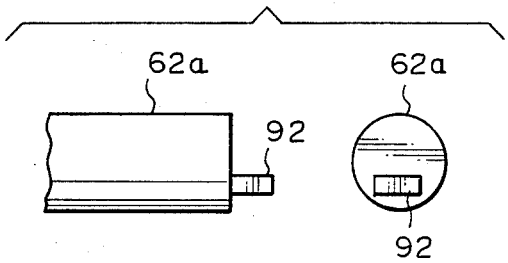
Figure 16D:
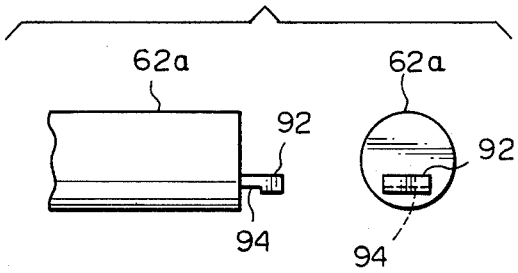

As shown in FIG. 15, the conductor tip 62*a* having a circular cross-section makes line-to-line contact with the conductor 82 on the substrate 68. Conductors having a circular cross-section are inexpensive to produce and, therefore, suitably applicable to general-purpose high frequency connectors. However, concerning millimeter wave applications, contacting portions of the center conductors should preferably be machined in order to allow a minimum of discontinuity of the line. Preferred configurations of the contacting portions of a center conductor are shown in sections in FIGS. 16A–16D. In FIG. 16A, a flat surface 88 which extends in one direction is included in the contact surface of the center conductor. In FIG. 16B, flat surfaces 90 extend in three different directions each conforming to the width of a conductor on the substrate 68. In FIG. 16C, a lug 92 having a rectangular section protrudes from the center conductor; this configuration is desirably applicable to the embodiment of FIGS. 10 and 11 in which the center conductor 62 and the substrate 68 are perpendicular to each other. To further enhance the contact, the lug 92 shown in FIG. 16C may be provided with a recess 94 in a lower part thereof, as shown in FIG. 16D.

As described above, the connector in accordance with any of the foregoing embodiments is capable of holding the center conductor 62 in contact with the conductor surface on the microstrip substrate 68 under adequate pressure. While the contact pressure in terms of normal component of a force of the contact surface is generally regarded acceptable if on the order of 0.2 N (Newton) in the case of gold (Au)-to-gold contact, it should preferably be about 5–12 N taking into account possible silver (Ag)-to-silver contact and entry of impurities between the contact surfaces. The magnitude of the normal component of a force on the contact surface will be described with reference to FIG. 17.

Figure 17:
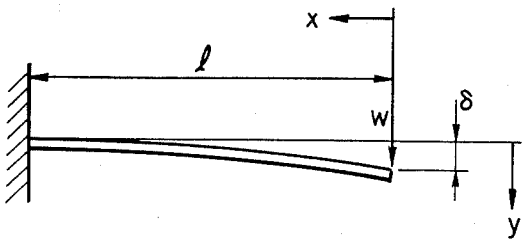
FIG. 17 is a diagram explanatory of calculation associated with a cantilever which represents a connector center conductor.

Referring to FIG. 17, assume that the center conductor 62 has a length l in a cantilevered position, and that the free end of the length l is at a coordinate x=0. A perpendicular load W acting on the free end causes the cantilever to deform in a direction y by an amount which is expressed as $$y = \frac{W}{6EI}(x^3 - 3l^2x + 2l^3)$$

where E is a Young's modulus determined by the material of the cantilever, and I a sectional secondary moment determined by the sectional shape of the cantilever. In the above equation, assuming that the displacement in the direction y is δ, $$\delta = \frac{W}{3EI}l^3$$

Figure 18:
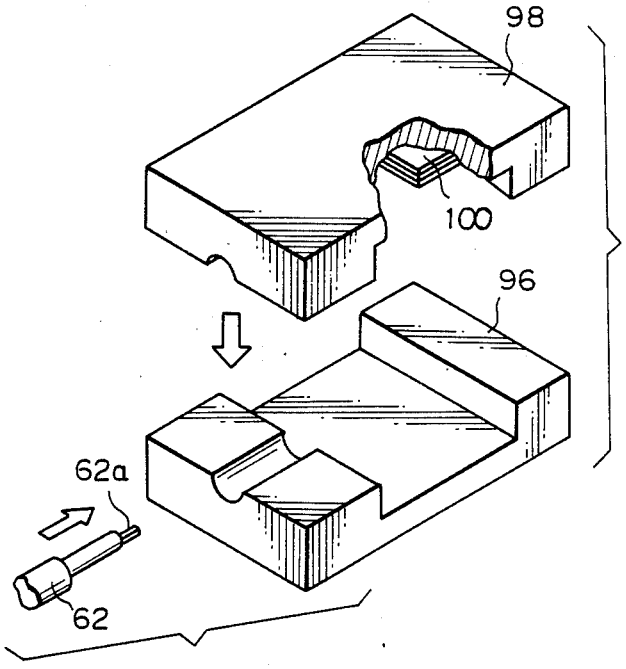
FIG. 18 is a perspective view of a pair of clamp jigs adapted to determine an amount deviation of a connector center conductor.
Figure 19:
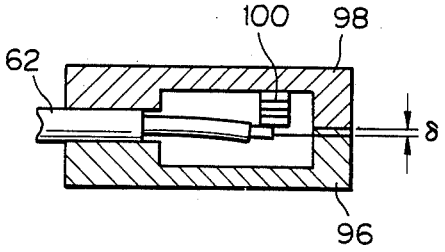
FIG. 19 is a section of the clamp jig shown in FIG. 18.

Therefore, where the normal component of a force necessary for the above-mentioned contact surface is W, it suffices to select an amount of deviation of the center conductor 62 which is equal to or greater than δ which is produced by the above equation. In practice, the deviation δ of the center conductor 62 is preferably accomplished by holding the center conductor 62 between a pair of clamp jigs 96 and 98 as shown in FIG. 18 and applying heat thereto. The jigs 96 and 98 are shown in a section in FIG. 19 together with the center conductor 62 held therebetween. The deviation δ is variable with the thickness of a spacer 100.

Figure 20A:
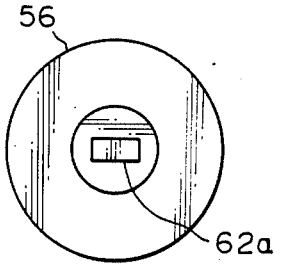
FIGS. 20A–20C are front views of different slit configurations which may be provided in a connector center conductor.
Figure 20B:
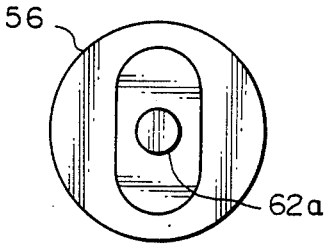
Figure 20C:
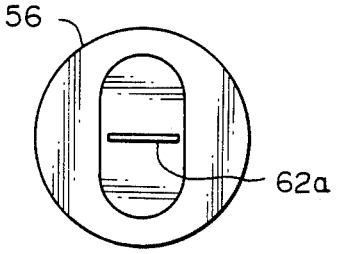

The slit **62*a* provided in the center conductor adjacent to an external circuit may have any suitable configuration such as shown in FIGS. 20A–20B**.

In summary, it will be seen that the present invention provides a high frequency connector which achieves various advantages as enumerated below:

(1) A microstrip circuit and a center conductor of a connector are directly connected to eliminate the need for an extra part otherwise required for the interconnection;

(2) Therefore, the interconnection is set up by a minimum number of steps;

(3) The interconnection is significantly stable partly because the circuit and the center conductor are constantly held in contact under predetermined pressure and partly because the center conductor absorbs any small error possibly developing in the distance between the circuit and the connector;

(4) The interconnection work is simple and does not require any skill;

(5) Since the contact pressure between the circuit and the center conductor is constant, the circuit is prevented from being damaged at the point of interconnection;

(6) No part is mounted on the center conductor to simplify interconnection of the center conductor to the circuit and, thereby, enhance machining precision as well as precision of the assembly, so that an excellent high frequency transmission characteristic is attained; and (7) The connector is inexpensive to produce because it can be mechanically produced on a quantity basis, does not need any additional part for interconnection, and remarkably reduces the steps involved in the interconnection.

Various modifications will become possible for those skilled in the art after receiving the teachings of the present disclosure without departing from the scope thereof.

What is claimed is:

1. A connector for interconnecting an external circuit mounted on a housing having a bore, said housing accommodating a high frequency circuit therein, and the high frequency circuit, comprising:

a tubular shell made of metal and mounted in the bore of the housing, said tubular shell including a hollow portion which functions as an external conductor, the shell further comprising a mating portion which is engageable in said bore;

an elongate center conductor extending on and along a center axis of said hollow portion of said shell and being connected at one end portion to the high frequency circuit and at the other end portion to the external circuit, said one end portion of the center conductor being made of spring material and being displaced relative to the center axis of the hollow portion of the shell such that the center conductor has a curve which is equivalent to approximately a displacement curve of a cantilever prior to connection with the high frequency circuit; and a support member made of insulating material for supporting said center conductor in the hollow portion of the shell;

the center conductor being cantilevered by said support member at a point of the center conductor which is remote from said one end portion and which is adjacent to said other end portion, a tip of said one end portion being free and movable toward the center axis of the hollow portion upon connection of the high frequency circuit, the center conductor thereby approaching coincidence with said center axis.

2. A connector as claimed in claim 1, wherein a major part of the cantilevered center conductor is positioned in the hollow portion of the shell.

3. A connector as claimed in claim 1, wherein the mating portion of the shell is relatively short, a major part of the cantilevered center conductor being positioned outside of the hollow portion of the shell.

4. A connector as claimed in claim 1, wherein said point where the center conductor is supported is remote from said one end portion by a distance which is five times a diameter of the center conductor.

5. A connector as claimed in claim 1, wherein said one end portion of the center conductor is made of a shape-memorizing alloy.

6. A connector as claimed in claim 1, wherein said one end portion of the center conductor has a circular cross-section.

7. A connector as claimed in claim 1, wherein the center conductor is slit in a portion which is adjacent to a tip of said one end of the center conductor, the tip of the center conductor being cantilevered and having a flat portion which is complementary to a center conductor of a microstrip line that is to be connected with the connector.

8. A connector for interconnecting an external circuit mounted on a housing having a relatively short bore, said housing accommodating a high frequency circuit therein, and the high frequency circuit, comprising:

a relatively short tubular shell made of metal and mounted in the bore of the housing, said tubular shell including a hollow portion which functions as an external conductor, the shell further comprising a mating portion which is engageable in said bore;

an elongate center conductor extending far beyond said relatively short tubular shell, and further extending on and along a center axis of said hollow portion of said shell, said connector being connected at one end portion which extends far beyond said shell to the high frequency circuit and at the other end portion to the external circuit, said one end portion of the center conductor being made of spring material and being displaced relative to the center axis of the hollow portion of the shell such that the center conductor has a curve which is equivalent to approximately a displacement curve of a cantilever prior to connection with the high frequency circuit; and a support member made of insulating material for supporting said center conductor in the hollow portion of the shell;

the center conductor being cantilevered by said support member at a point of the center conductor which is remote from said one end portion and which is adjacent to said other end portion, a tip of said one portion being free and movable toward the center axis of the hollow portion upon connection of the high frequency circuit, the center conductor thereby approaching coincidence with said center axis.

* * * * *

UNITED STATES PATENT AND TRADEMARK OFFICE

CERTIFICATE OF CORRECTION

PATENT NO. : 4,669,805

DATED : June 2, 1987

INVENTOR(S) : Yuhei Kosugi and Shigeo Ogawa

It is certified that error appears in the above-identified patent and that said Letters Patent is hereby corrected as shown below: Title page, insert Item [73] to read as follows:

Assignee : --NEC Corporation, Japan--.

Signed and Sealed this

Eighth Day of March, 1988

*Attest:*

DONALD J. QUIGG

*Attesting Officer*

*Commissioner of Patents and Trademarks*